US010060105B2

(12) United States Patent
Lin et al.

(10) Patent No.: US 10,060,105 B2
(45) **Date of Patent: *Aug. 28, 2018**

(54) COMBINATION SHOWERHEAD WITH PRESS BUTTON SWITCHING

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 34 days.

This patent is subject to a terminal disclaimer.

(21) Appl. No.: 15/334,940

(22) Filed: Oct. 26, 2016

(65) Prior Publication Data

US 2017/0167121 A1 Jun. 15, 2017

(30) Foreign Application Priority Data

Dec. 11, 2015 (CN) ..... 2015 1 0921319

(51) Int. Cl.
*B05B 1/18* (2006.01)
*E03C 1/04* (2006.01)
(Continued)

(52) U.S. Cl.
CPC ..... *E03C 1/0404* (2013.01); *B05B 1/1636* (2013.01); *B05B 1/18* (2013.01);
(Continued)

(58) Field of Classification Search
CPC ... B05B 1/1627; B05B 1/1636; B05B 1/1681; B05B 1/18; B05B 1/185; B05B 1/16; E03C 1/0408; E03C 1/0404
See application file for complete search history.

(56) References Cited

U.S. PATENT DOCUMENTS 7,665,676 B2 * 2/2010 Lev ..... B05B 1/16 239/442
8,695,897 B2 * 4/2014 Engel ..... B05B 1/1654 239/393

(Continued)

FOREIGN PATENT DOCUMENTS

CN 103521369 A 1/2014

*Primary Examiner* — Alexander Valvis
(74) *Attorney, Agent, or Firm* — Rabin & Berdo, P.C.

(57) ABSTRACT

A combination showerhead with press button switching includes a fixing holder mounted to a supporting arm and including an inlet passage and at least two diversion passages; a first showerhead mounted to the fixing holder and connected to at least one diversion passage; a second showerhead connected to another diversion passage; and a switching mechanism including a diversion plate movable relative to the fixing holder and cooperating with passages to switch waterways by a predetermined angle of rotation; a sliding block slidably connected to the fixing holder; a transmission mechanism connected between the sliding block and the diversion plate to drive the diversion plate to rotate by back-and-forth sliding of the sliding block; and a press button movably connected to the fixing holder and connected to the sliding block to drive the sliding block to slide. The transmission mechanism includes a valve core and a shaft.

14 Claims, 11 Drawing Sheets

(51) Int. Cl.
*B05B 1/16* (2006.01)
*B05B 15/65* (2018.01)

(52) U.S. Cl.
CPC ..... *B05B 1/185* (2013.01); *B05B 15/65* (2018.02); *E03C 1/0408* (2013.01)

(56) References Cited

U.S. PATENT DOCUMENTS

| | | | | |
|---|---|---|---|---|
| 8,720,799 | B2 * | 5/2014 | Tseng | E03C 1/06 239/282 |
| 2009/0007330 | A1 * | 1/2009 | Genord | B05B 1/16 4/695 |
| 2014/0054398 | A1 * | 2/2014 | Lev | B05B 1/185 239/443 |
| 2017/0165682 | A1 * | 6/2017 | Lin | B05B 1/1627 |
| 2017/0165684 | A1 * | 6/2017 | Lin | B05B 1/1627 |
| 2017/0165685 | A1 * | 6/2017 | Lin | B05B 1/1627 |
| 2017/0165686 | A1 * | 6/2017 | Lin | B05B 1/18 |
| 2017/0173603 | A1 * | 6/2017 | Lin | B05B 1/1663 |

* cited by examiner

COMBINATION SHOWERHEAD WITH PRESS BUTTON SWITCHING

FIELD OF THE INVENTION

The present invention relates to combination showerhead, and especially to a combination showerhead with press button switching.

BACKGROUND OF THE INVENTION

The existing combination showerhead, as Chinese patent No. 103521369A disclosed, is a shower system comprising a top-spray showerhead with at least two spray types and a handle showerhead, and the top-spray showerhead is disposed with an inlet passage for water supply and first diversion passages corresponding to spray types; the top-spray showerhead is disposed with a second diversion passage connected to the handle showerhead by a hose; a switching mechanism disposed on the top-spray showerhead is capable of switching waterway by cooperating with the inlet, first passages and second passages, thereby any of the diversion passage could be selected to connect with the inlet, however, the structure is not compact enough and needs further improvement.

SUMMARY OF THE INVENTION

The objective of present invention is to provide combination showerhead with press button switching, which overcome the disadvantages of the existing technology.

The technical proposal of the present invention is that:

A combination showerhead with press button switching comprising: a fixing holder (10) mounted to supporting arm, a first showerhead (20) mounted to the fixing holder, a second showerhead (30) and a switching mechanism (40), the fixing holder (10) comprises an inlet passage (11) connected to the supporting arm and at least two diversion passages (12) of which one is connected to the second showerhead (30) and others are connected to the first showerhead (20);

wherein the switching mechanism (40) comprises a diversion plate (41), a transmission mechanism, a sliding block (43) and a press button (45); the diversion plate (41) is at least movable relative to the fixing holder (10) and cooperated with the inlet passage (11) and the diversion passages (12) to switching waterway by predetermined angle rotating; the sliding block (43) is slidably connected to the fixing holder (10), the transmission mechanism is connected between the sliding block (43) and the diversion plate (41) in transmission way to drive the diversion plate (41) to rotate in predetermined angle by back-and-forth sliding of the sliding block; the press button (45) is movably connected to the fixing holder (10) and connected to the sliding block (43) in transmission way to drive the sliding block (43) to slide.

In one preferred embodiment, the transmission mechanism 555 comprises a valve core (42) slidably connected to the fixing holder (10) and a shaft (46) fixed to the diversion plate (41), slip directions of the valve core (42) and the sliding block (43) intersect, and sliding of the sliding block (43) drives the valve core (42) to slide, back-and-forth sliding of the valve core (42) drives the shaft (46) along with the diversion plate (41) to rotate in predetermined angle.

In another preferred embodiment, the end of the valve core (42), the end of the shaft (46) and the fixing holder (10) are disposed with ratchets; the diversion plate (41) is rotatable and movable along rotation axis relative to the fixing holder (10); the switching mechanism (40) further comprises a elastomer (44) abuts against between the diversion plate (41) and the fixing holder (10); the ratchets disposed on the end of the valve core (42), the shaft (46) and the fixing holder (10) work in co-ordination to form pencil lead mechanism.

In another preferred embodiment, the sliding block (43) is disposed with a first inclined plane (431) for guiding, and the valve core (42) abuts against the first inclined plane (431) of the sliding block (43).

In another preferred embodiment, bottom of the valve core (42) is disposed with a second inclined plane (421) for guiding and the second inclined plane (421) abuts against the first inclined plane (431).

In another preferred embodiment, the press button (45) is slidably connected to the fixing holder (10), and the press button (45) abuts against or be fixed on the sliding block (43).

In another preferred embodiment, the switching mechanism (40) further comprises a spring (47) abuts against between the sliding block (43) and the fixing holder (10).

In another preferred embodiment, back of the fixing holder (10) is convexly disposed with a assembly portion (13) and the switching mechanism (40) is disposed inside the assembly portion (13), the press button (43) is movably connected to the assembly portion (13) with at least part locates outside for pressing.

In another preferred embodiment, the second showerhead (30) is handle showerhead; the outlet of the diversion passages (12) connected to the second showerhead (30) is disposed on the sidewall of the assembly portion (13), and the handle showerhead connects with corresponding outlet through a flexible hose (50), front lower part of the fixing holder (10) is disposed with a connecting portion (14) for handle showerhead positioning.

In another preferred embodiment, the second showerhead (30) is fixed showerhead fixed on the front lower part of the fixing holder (10).

In another preferred embodiment, the fixing holder (10) has a common portion (15) and two forking portion (16) forking extend from the common portion (15), the first showerhead (20) is rotatably connected between the two forking portion (16); a hose piece (21) is disposed along the rotation axis of the first showerhead (20) and connected to the first showerhead (20), and other diversion passages (12) is connected to the first showerhead (20) along the hose piece (21).

In another preferred embodiment, the assembly portion (13) is disposed on the back of the common portion (15).

In another preferred embodiment, the first showerhead (20) is capable of rotatably connected to the fixing holder (10), and a damping mechanism (60) is disposed between the fixing holder (10) and the first showerhead (20).

In another preferred embodiment, the damping mechanism (60) comprises a locating holder (61), a turning block (62) and a cam (63), at least two dangling pieces (64) disposed separately in circumferential direction on the locating holder (61) form a rotary sleeve-like structure with at least part of the inner wall being of radii changing, the cam (63) is disposed in the rotary sleeve to match the radii changing part, the turning block (62) is sleeved on the rotary sleeve, friction force of the dangling pieces (64) and the turning block (62) changes with rotation of the cam (63) relative to the radii changing part and thereby the damping changes.

In another preferred embodiment, the fixing holder (10) has a common portion (15) and the first showerhead (20) is rotatably connected to the common portion (15); at least a hose piece (21) disposed along the rotation axis of the first showerhead (20) is connected to the first showerhead (20), and other diversion passages (12) are connected to the first showerhead (20) along the hose piece (21).

Comparing to the existing technology, the present invention has advantages as follows:

1. The switching mechanism is disposed on fixing holder; the first showerhead could be new design or existing one; the switching mechanism comprises diversion plate, transmission mechanism, sliding block and press button, the press button drives the sliding block to slide and the sliding block drives the diversion plate to rotate through transmission mechanism, thereby the switching is realized; The switching with press button driving is novel and convenient for one-handed operation, moreover, the slip direction of the sliding block and the position of the press button could be disposed according to the structure requirement of the fixing holder, which is of reasonable layout and compact structure.

2. The transmission mechanism comprises valve core and shaft, sliding of the sliding block drives the valve core to slide, and sliding of the valve core drives the shaft along with the diversion plate to rotate in predetermined angle; slip directions of the valve core and the sliding block intersect, thereby the slip direction of the sliding block could be disposed according to the structure requirement of the fixing holder, which is of reasonable layout and compact structure.

3. All the valve core, shaft and fixing holder are disposed with ratchets, the ratchets works in co-ordination to form pencil lead mechanism, push of valve core drives shaft to slide upward and rotate positively in ½ predetermined angle, and reset of valve core drives shaft to slide downward and rotate positively in ½ predetermined angle again, thereby back-and-forth sliding of the valve core drives the shaft along with diversion plate to rotate in predetermined angle, which is of simple structure, dependable switching stability and easy operation.

4. The second inclined plane abuts against the first inclined plane, and thereby the transmission is stable and reliable.

5. Back of the fixing holder is convexly disposed with an assembly portion and the switching mechanism is disposed inside the assembly portion, the press button is movably connected to the assembly portion with at least part locates outside for user's pressing, which is of reasonable layout, compact structure, good-looking appearance and easy operation.

6. A connecting portion for handle showerhead positioning is disposed on the front lower part of the fixing holder, which facilitate the user to take down or lay up with good-looking appearance.

7. The fixing holder has common portion and forking portions, the first showerhead is rotatably connected between the two forking portions; since the first showerhead is rotatable, users can adjust the angle of water flowing according to needs, which is convenient.

8. Damping mechanism is disposed between the forking portion of the fixing holder and the first showerhead so that the first showerhead could be positioned in a certain angle.

9. With rotation of the cam relative to the radii changing part, friction force of the dangling pieces and the turning block changes and thereby the damping changes, which is of simple and compact structure and easy to use.

BRIEF DESCRIPTION OF THE DRAWINGS

The present invention will be further described with the drawings and the embodiments.

DETAILED DESCRIPTION OF THE EMBODIMENTS

Figure 1:
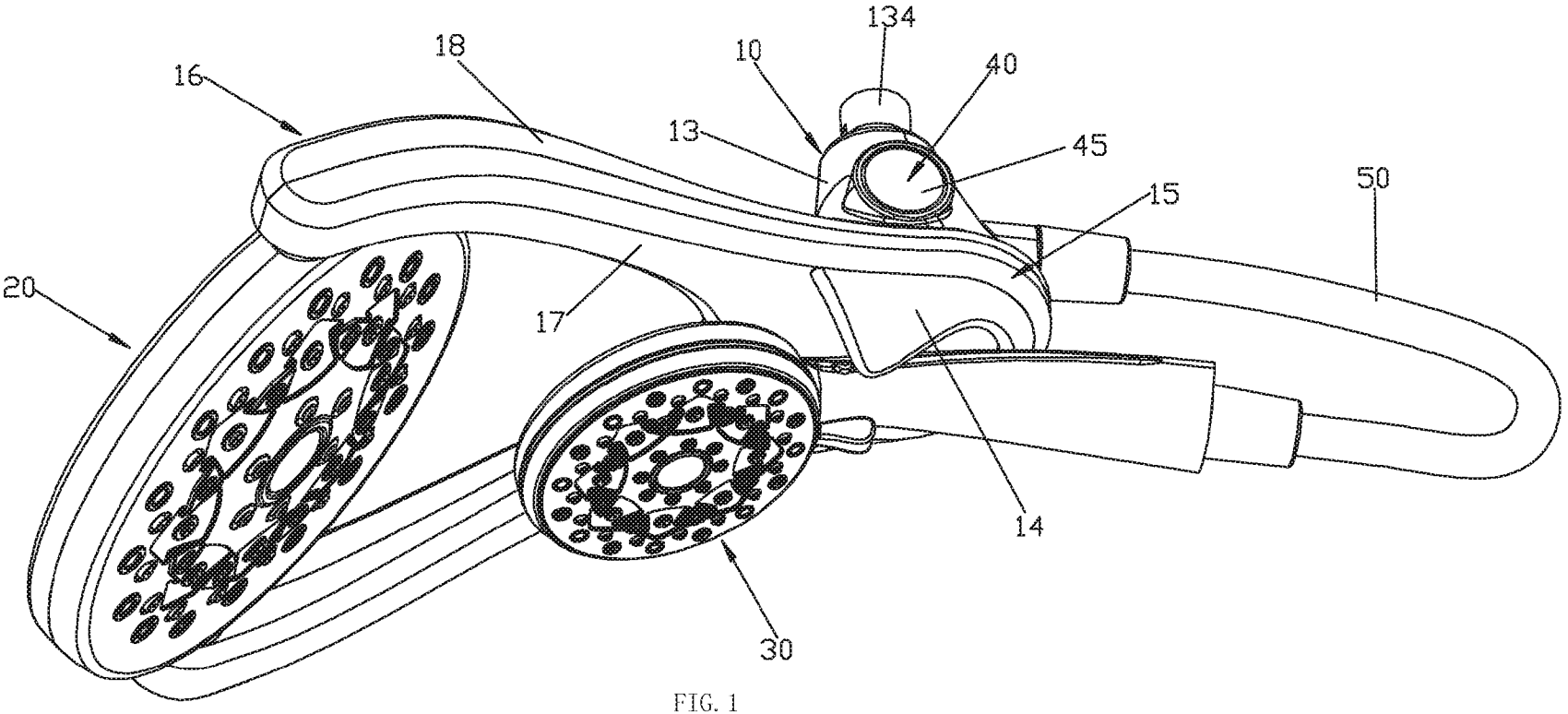
FIG. 1 illustrates a perspective schematic diagram of the combination showerhead of a preferred embodiment.
Figures 2, 3:
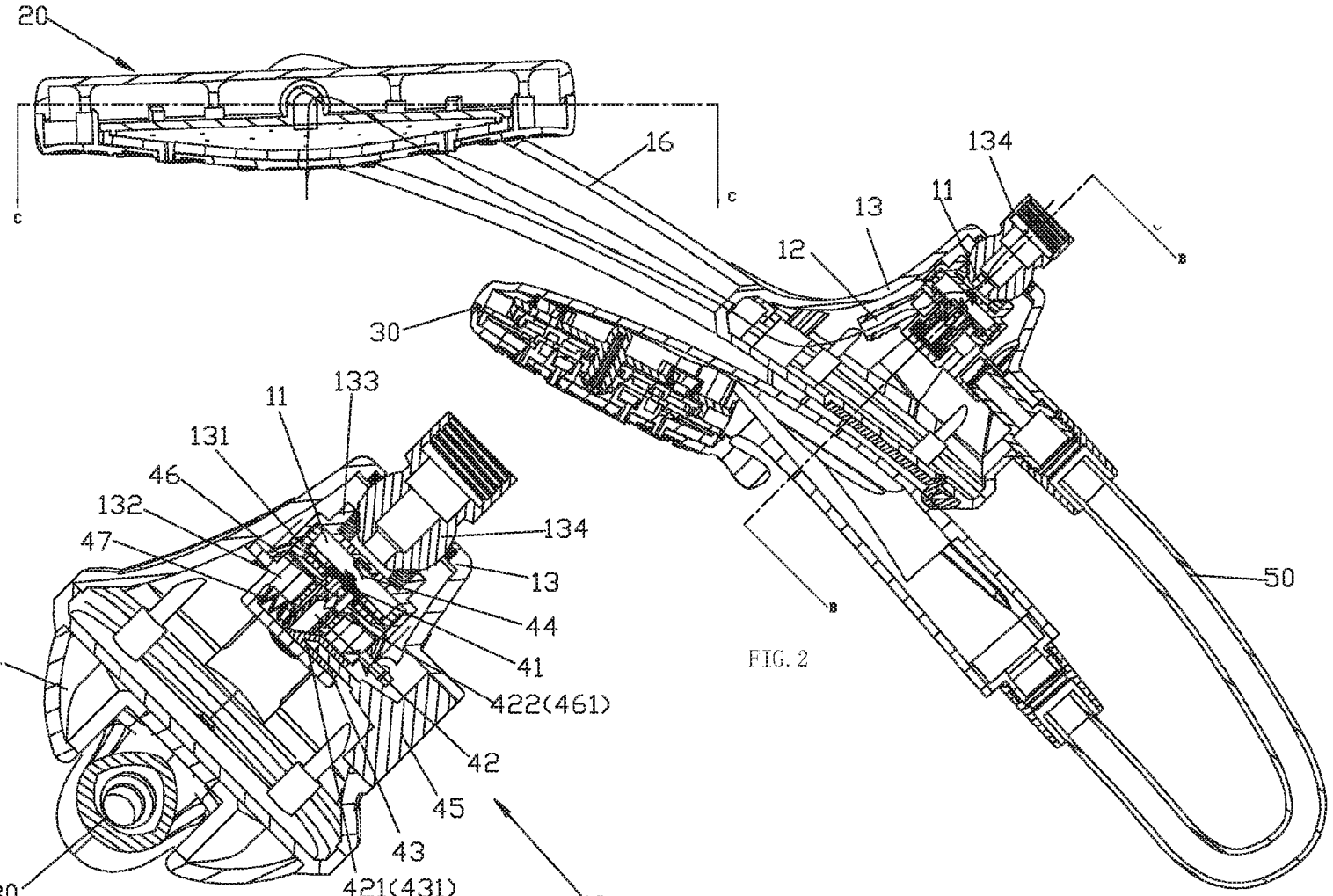
FIG. 2 illustrates a cross-section schematic diagram of the combination showerhead of a preferred embodiment under condition that water flows from the first showerhead.
FIG. 3 illustrates a B-B cross-section schematic diagram of the combination showerhead of FIG. 2.
Figure 4:
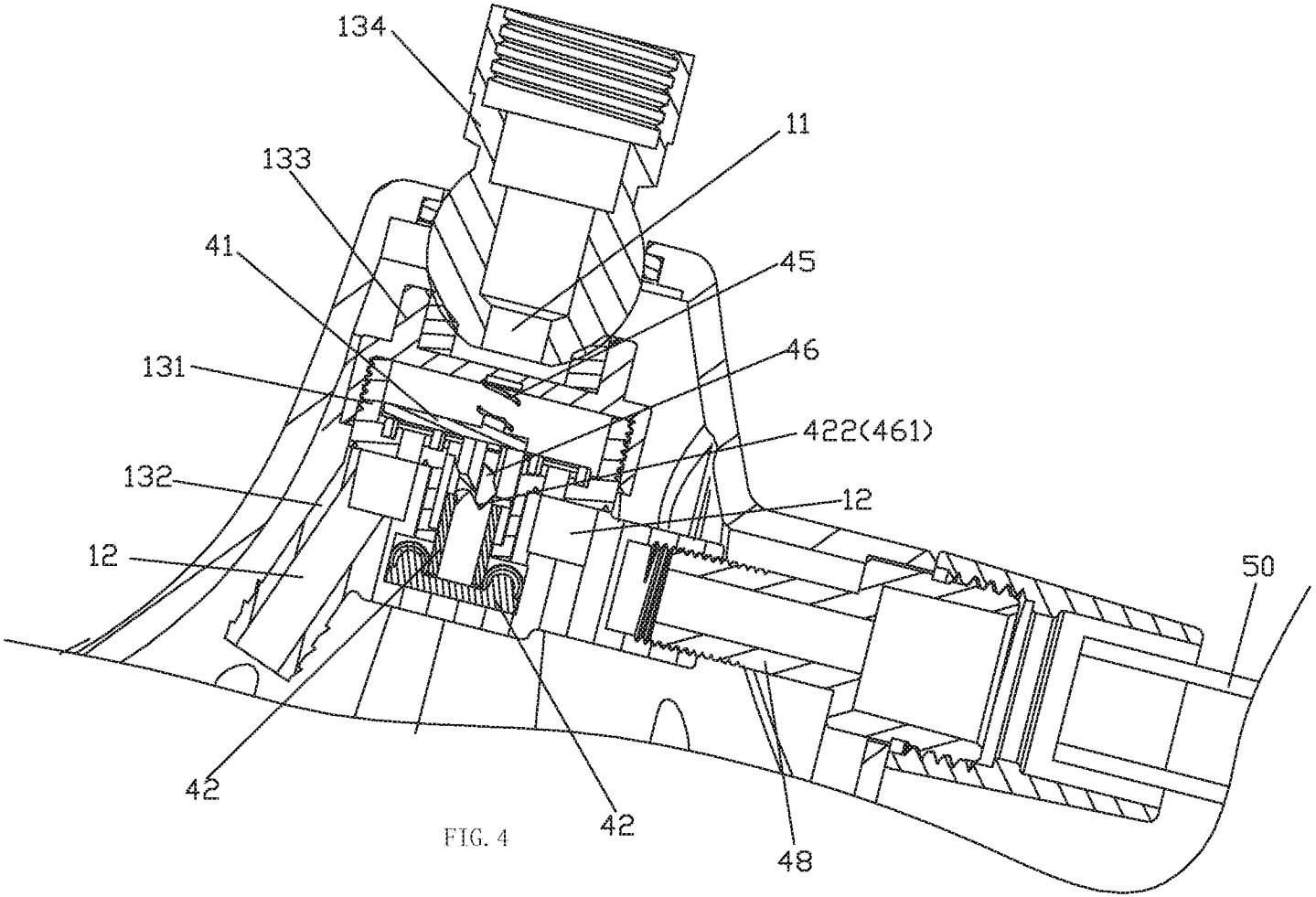
FIG. 4 illustrates a local enlarged schematic diagram of the combination showerhead of FIG. 2.

Combination showerhead with press button switching refers to FIG. 1 to FIG. 12 comprises fixing holder 10, first showerhead 20, second showerhead 30 and switching mechanism 40. Fixing holder 10 could be mounted to supporting arm which could be water supply pipe fixed on the wall and the connection could be permanent connection or universal connection coordinate with spherical structure. The first showerhead 20 could be top spray showerhead or head showerhead mounted to fixing holder 10. The first showerhead 10 could have one or more function for different water spray types. Fixing holder 10 comprises inlet passage 11 connected to supporting arm and at least two diversion passages 12.

One diversion passage 12 is connected to second showerhead 30;

Others are connected to first showerhead 20, wherein:

If the first showerhead 20 has one water spray function, the amount of diversion passages 12 is 2.

Figure 5:
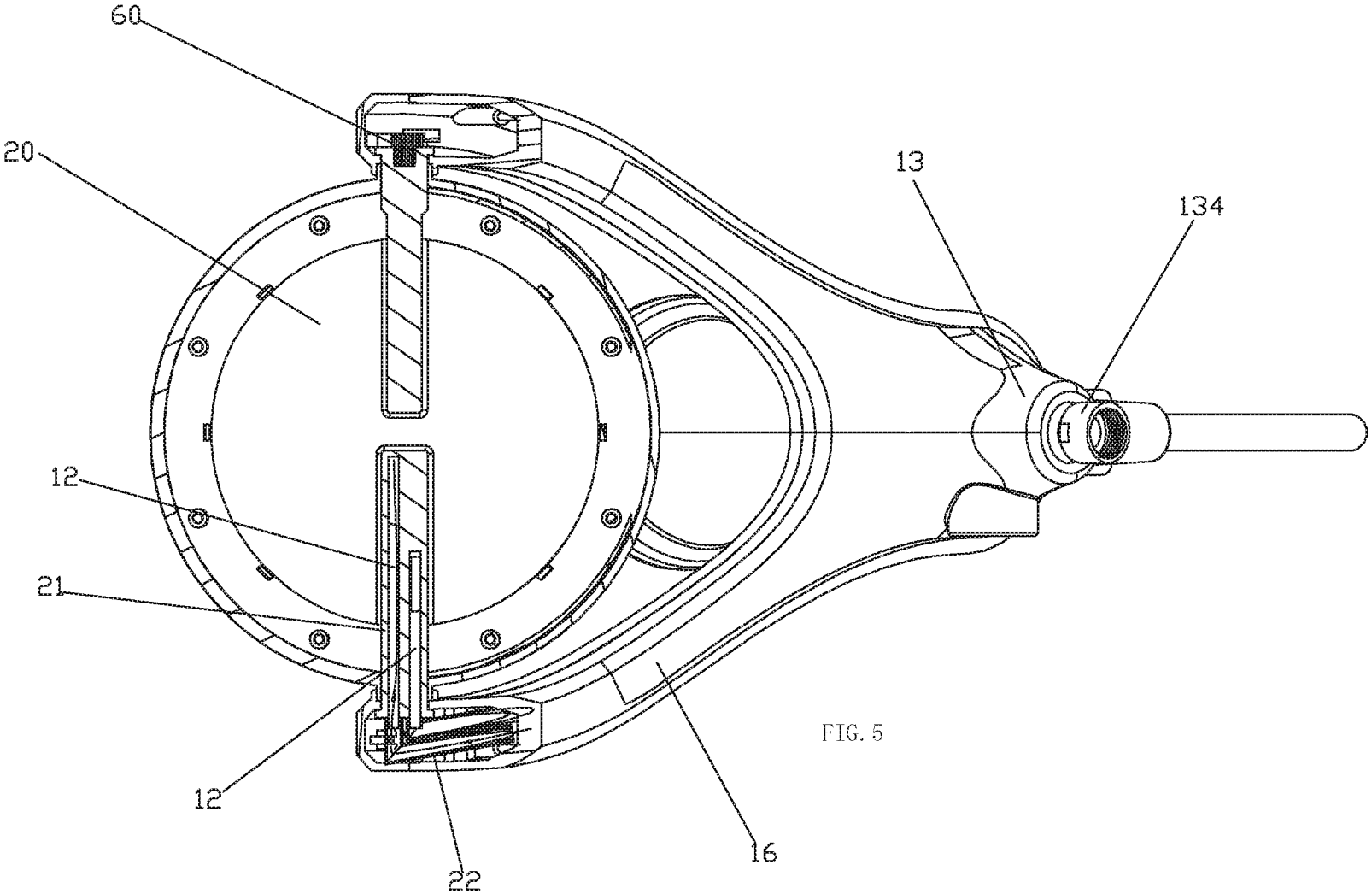
FIG. 5 illustrates a C-C cross-section schematic diagram of the combination showerhead of FIG. 2 under condition of the first function.
Figure 6:
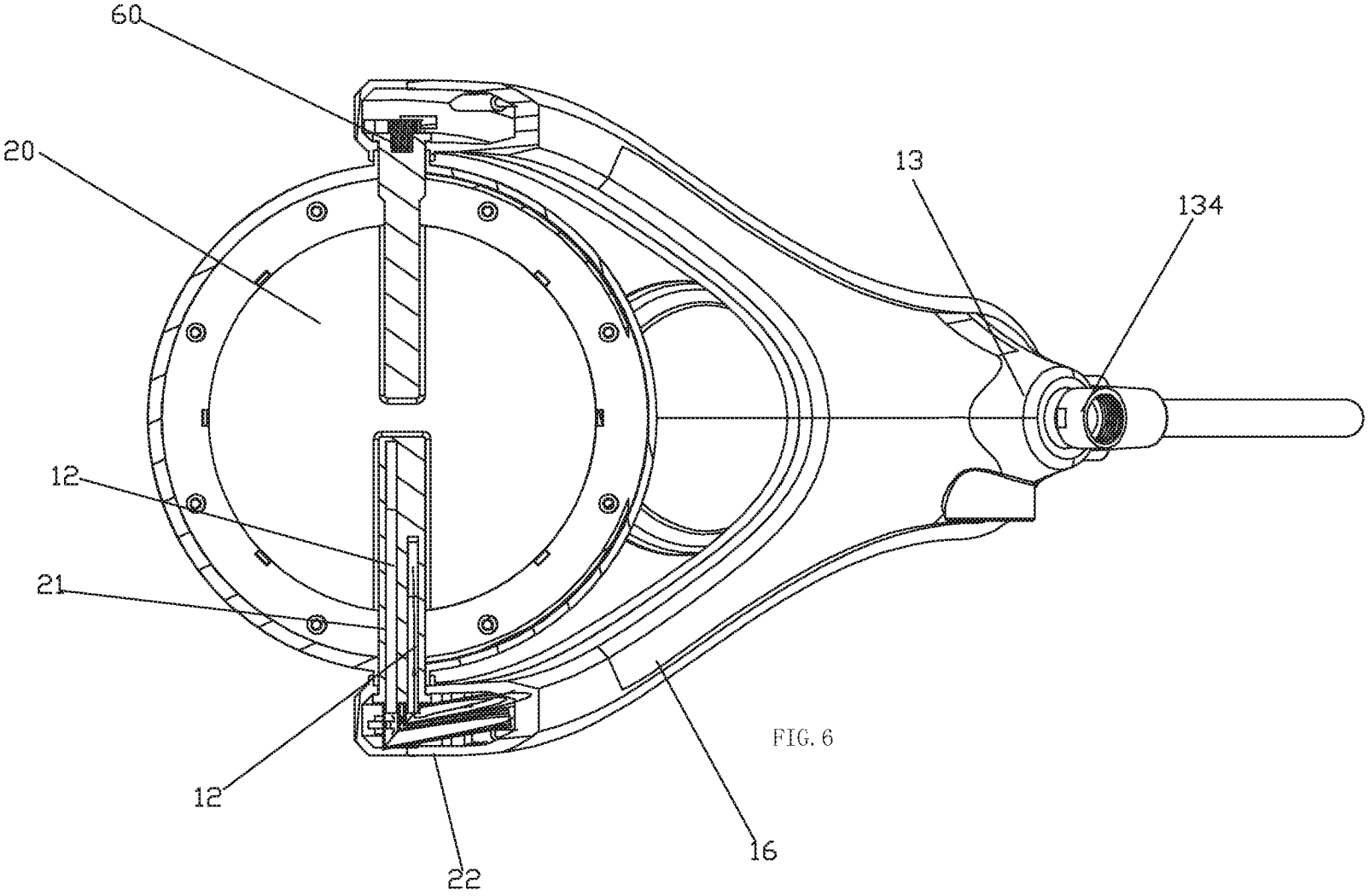
FIG. 6 illustrates a C-C cross-section schematic diagram of the combination showerhead of FIG. 2 under condition of the second function.
Figure 7:
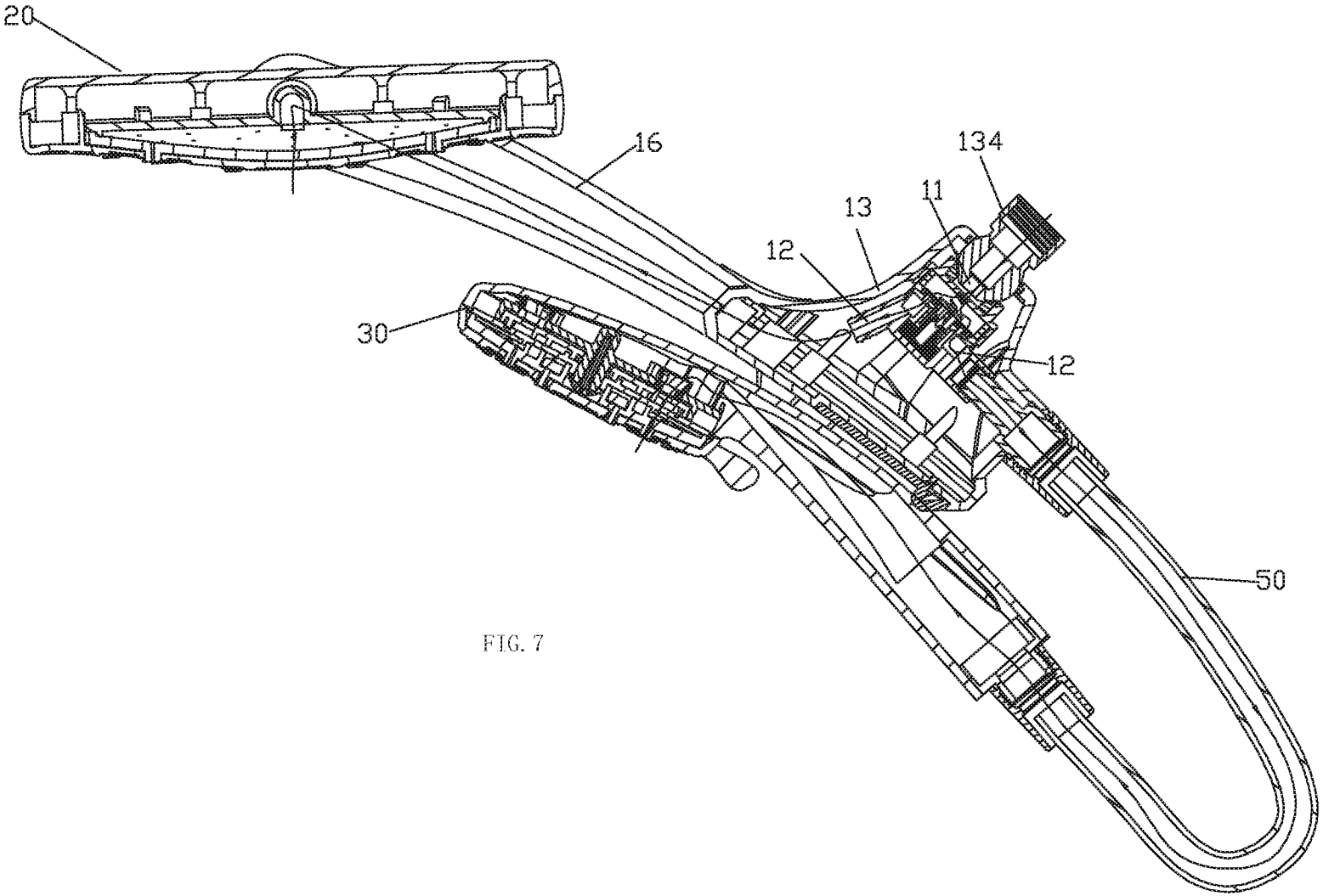
FIG. 7 illustrates a cross-section schematic diagram of the combination showerhead of a preferred embodiment under condition that water flows from both of the first showerhead and second showerhead.
Figure 8:
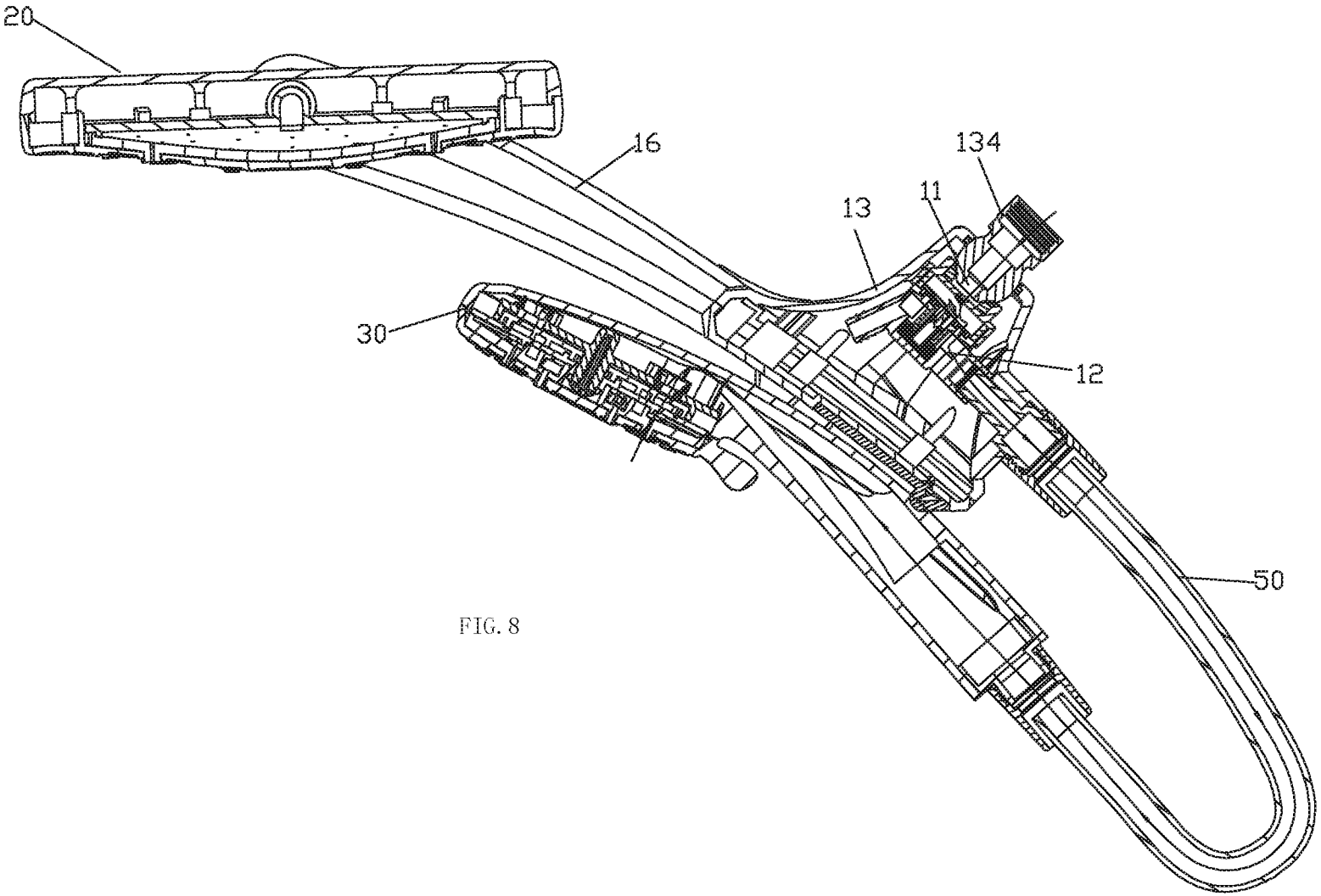
FIG. 8 illustrates a cross-section schematic diagram of the combination showerhead of a preferred embodiment under condition that water flows from the second showerhead.
Figure 9:
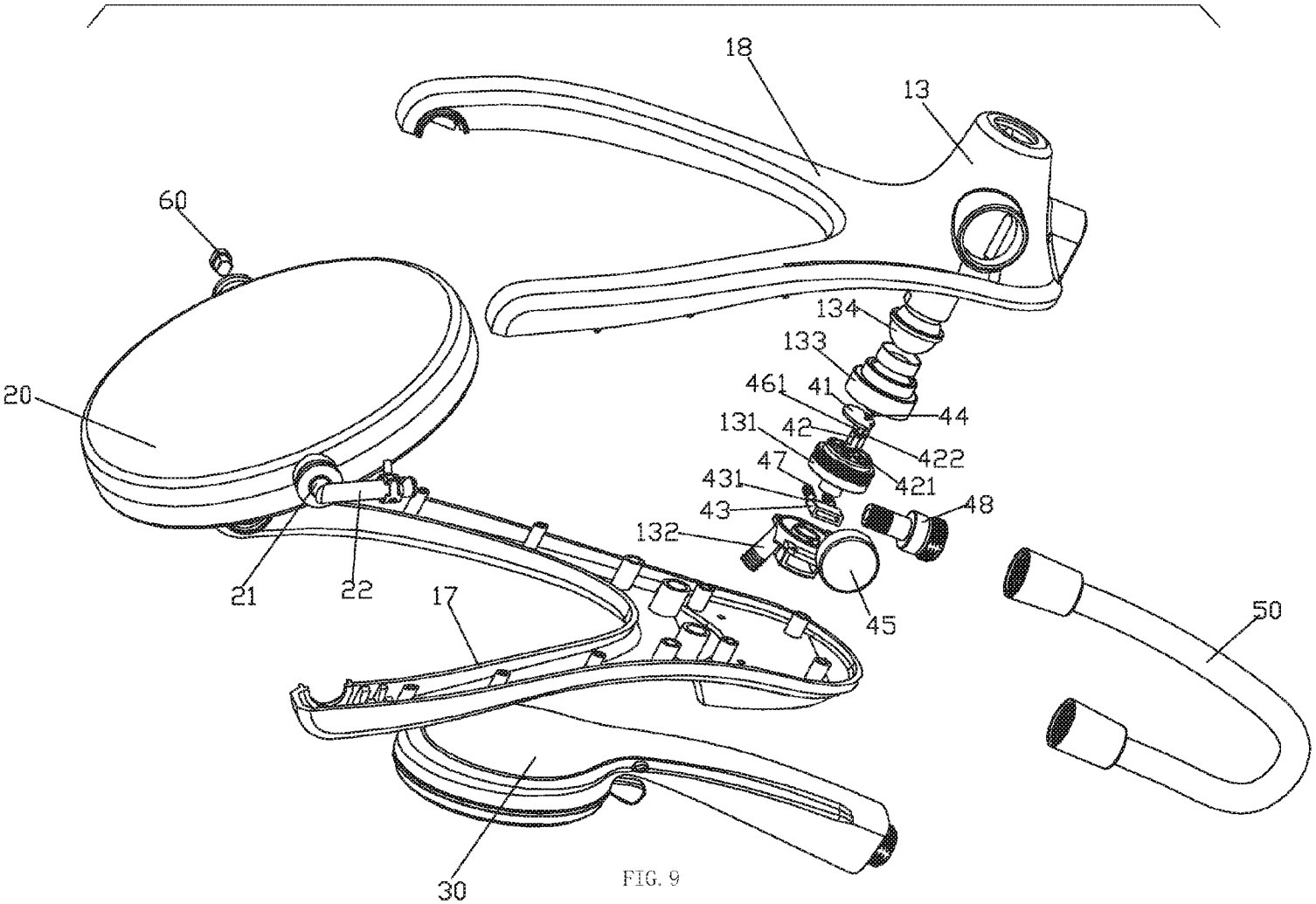
FIG. 9 illustrates an exploded perspective schematic diagram of the combination showerhead of a preferred embodiment.
Figure 11:
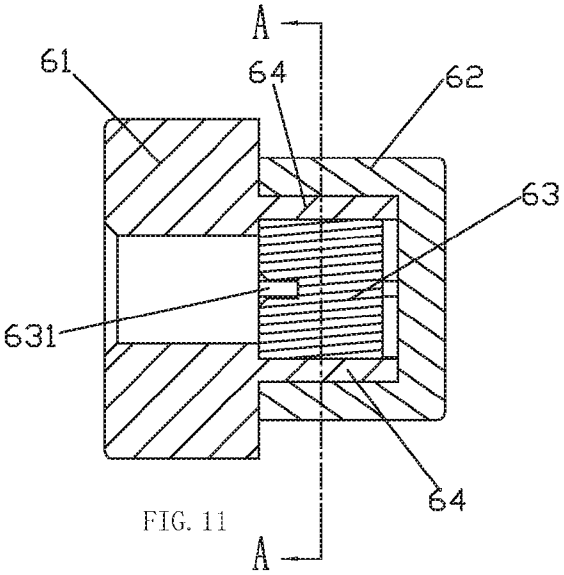
FIG. 11 illustrates a cross-section schematic diagram of the damping mechanism of a preferred embodiment.
Figure 10:
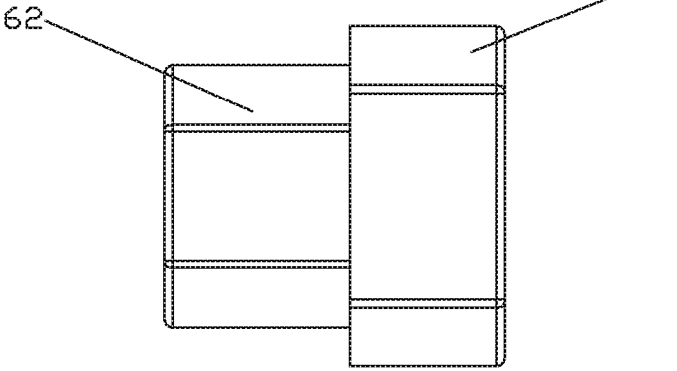
FIG. 10 illustrates a front view of the damping mechanism of a preferred embodiment.
Figure 12:
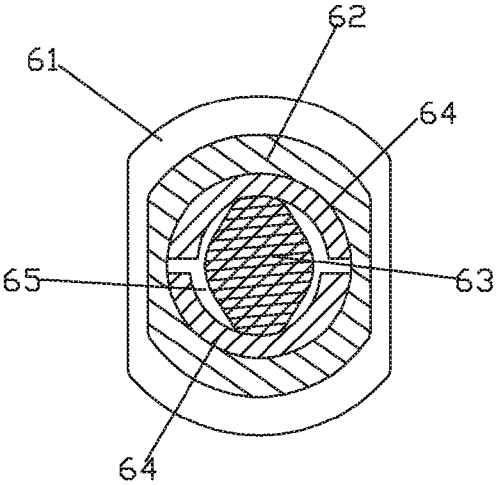
FIG. 12 illustrates an A-A cross-section schematic diagram of the damping mechanism of FIG. 11.

If the first showerhead 20 has more than one water spray function, the amount of other diversion passages 12 could be 1, and the switching of first showerhead and second showerhead is realized by switching mechanism 40 while switching of water spray function on the first showerhead 20 is realized by another switching mechanism which is additional; or the amount of other diversion passages 12 could be equal to the amount of function with one to one connection, and switching mechanism 40 is capable of switching the second showerhead 30 and functions of the first showerhead 20, as shown in FIG. 5 and FIG. 6.

Fixing holder 10 has a common portion 15 and two forking portion 16 forking extend from common portion 15, and the back of common portion 15 is convexly disposed with assembly portion 13. In this embodiment, fixing holder 10 comprises front cover 17 and back cover 18, first cover 17 and back cover 18 are fixed and connected to form common portion and forking portion described above. Through hole is disposed on back cover corresponding to common portion and the edge of through hole extends backwards to form assembly portion 13.

Switching mechanism 40 is mounted in assembly portion 13 for switching at least two diversion passages 12 to connect with inlet passage so as to switching the first showerhead and the second showerhead/different functions of the second showerhead. The switching could be between water flows from the first showerhead or second showerhead/any water spray function of second showerhead, or, between water flows from the first showerhead or second showerhead/any water spray function of second showerhead only or both of the first showerhead and second showerhead. Switching mechanism 40 comprises diversion plate 41, transmission mechanism, sliding block 43, elastomer 44 and press button 45 and spring 47. Diversion plate 41 is connected to fixing holder 10 in a way that it is rotatable and movable along rotation axis relative to fixing holder 10 and cooperated with inlet passage 11 and diversion passages 12 so as to switch waterway by predetermined angle rotating. For example, diversion plate 41 could have through hole and with alignment or separation of through hole and diversion passages to realize water connection or disconnection, or, diversion plate 41 could be fan-shaped and cover diversion hole of diversion passage 12 completely or incompletely to realize water connection or disconnection. The sliding block 43 can slide vertically to the axis of the diversion plate relative to assembly portion of the fixing seat 10, transmission mechanism is connected between sliding block 43 and diversion plate 41 in transmission way so that back-and-forth sliding of sliding block 43 drives diversion plate 41 to rotate step-by-step in predetermined angle; press button 45 is slidably connected to fixing holder 10 and connected to sliding block 43 in transmission way to drive sliding block 43 to slide; elastomer 44 abuts against between diversion plate 41 and the fixing holder with which elastic force towards shaft is applied on the diversion plate, thereby resetting the diversion plate in axial and the valve core is reset; spring 47 is capable of resetting sliding block 43.

Specifically, assembly portion is disposed with slide through hole and press button is slidably connected in slide hole and at least part locates outside for pressing; side of the sliding block opposite to the press button is concavely disposed with a slot, the press button opposite to the sliding block is disposed with a plug, and the plug insets into the slot and fixed so that press button could slide together with sliding block; The transmission mechanism comprises valve core 42 slidably connected to fixing holder 10 and shaft 46 fixed to diversion plate 41, slip directions of valve core 42 and sliding block 43 intersect, for example, the sliding block slides along radial direction of assembly portion while valve core along axial direction, and sliding of sliding block 43 drives the valve core 42 to slide. The end of valve core 42 and shaft 46 are disposed with ratchets 422 and 461 respectively, and fixing holder 10 is disposed with ratchets also, ratchets works in co-ordination to form pencil lead mechanism. Valve core 42 drives shaft 46 together with diversion plate 41 to slide upward and rotate positively in ½ predetermined angle, and reset of valve core 42 drives shaft 46 together with diversion plate 41 to slide downward and rotate positively in ½ predetermined angle again. Elastomer 44 abuts against between sides of diversion plate back to shaft and assembly portion, since diversion plate moves upward, elastomer is in pressure, as press button released, elastomer is also released to drive diversion plate slide back, so as to reset valve core. When user push the press button upward, valve core slide upward together with valve core, valve core drive shaft 46 together with diversion plate to slide upward and rotate positively in ½ predetermined angle, and elastomer stores energy meanwhile; when release the press button, elastomer is also released and push diversion plate to slide downward and rotate positively in ½ predetermined angle together with shaft again, thereby push valve core and press button to reset. Preferably, sliding block 43 is disposed with a first inclined plane 431 for guiding, bottom of valve core 42 is disposed with a second inclined plane 421 for guiding and the second inclined plane 421 abuts against the first inclined plane 431. The spring 47 abuts against between sliding block 43 back facing press button and assembly portion of fixing holder 10. When user presses press button 45, press button 45 along with sliding block 43 slides inward, and with cooperation of the first inclined plane 431 and the second inclined plane 421, valve core 42 slides upward and drives shaft to rotate in ½ predetermined angle, in this situation, elastomer and spring compress and store energy; when press button 45 is undone, the diversion plate slides downward and rotates positively in ½ predetermined angle under elastic force of elastomer 44 and thereby drives valve core to reset; sliding block and press button also reset under action of spring 47.

In this embodiment, fixing holder further comprises fixing seat 131, diversion body 132 and connecting seat 133 disposed in assembly portion; connecting seat 133 is mounted to supporting arm via ball joint 134. Diversion cavity is formed between connecting seat 133 and fixing seat 131 which form part of inlet passage 11. Diversion plate 41 is rotatably connected on fixing seat 131 and elastomer 44 is configured between diversion plate and connecting seat 133 so that diversion plate 41 is rotatably connected on the bottom of fixing seat 131 in seal. Fixing seat 131 is disposed with at least two diversion holes to form part of diversion passages 12 respectively, and with rotating of diversion plate, different diversion holes connecting to diversion cavity is switched, so that switching of different diversion passages connecting to inlet passage 11 is realized. Diversion body 132 is mounted to fixing seat 131 and comprises at least two water passages which connecting to diversion holes respectively and form part of diversion passages 12. Fixing seat 131 is disposed with through-hole, shaft pass through through-hole rotatably while valve core is slidably connected in through-hole, and ratchets of fixing holder is disposed on through-hole; diversion body 132 is concavely disposed with groove and sliding block and elastomer are connecting in groove, sliding block works coordinated with valve core and press button.

The first showerhead 20 is rotatably connected between two forking portion 16. A hose piece 21 disposed along the rotation axis of the first showerhead 20 is connected to the first showerhead 20 and a tube 22 is disposed on the other end. The hose piece 21 and tube 22 forms a L-shape, and other diversion passages 12 are disposed along hose piece 21 and tube 22. If there is only one diversion passage 12, then hose piece 21 and tube 22 could be part of diversion passage.

A damping mechanism 60 is disposed between forking portion 16 of fixing holder 10 and the first showerhead 20, which comprises locating holder 61, turning block 62 and cam 63. Locating holder 61 comprises a base and two dangling pieces 64 disposed separately in circumferential direction of locating holder 61 which forms a rotary sleeve-like structure as lancing forms between two dangling pieces 64. Outer wall of rotary sleeve-like structure is rotative surface, while inner wall is radii changing and forms radii changing part, cam 63 is disposed in the rotary sleeve to match the radii changing part; turning block 62 is sleeved on the rotary sleeve, friction force of dangling pieces 64 and turning block 62 changes with rotation of the cam 63 relative to the radii changing part and thereby the damping changes. In a preferred situation, the base is perforative so that one end surface of cam 63 is exposed and disposed with matching groove 631 for driving cam to rotate by users. Locating holder 61 and turning block 62 are connecting on components with relative rotation respectively, such as forking portion and the first showerhead.

In one embodiment, the second showerhead 30 is handle showerhead. Front lower part of common portion 15 is disposed with a connecting portion 14 for handle showerhead positioning. Connecting portion could, but not limited, be a plug base or magnetic structure. The diversion passage 12 connected to the second showerhead 30 is further comprises a connector 46 to connect one water passage of the diversion body, and end opening of connector 46 forms water outlet. The connector could pass through assembly portion 13, and the handle showerhead is connected to outlet of corresponding diversion passage 12 via a hose 50.

Figure 13:
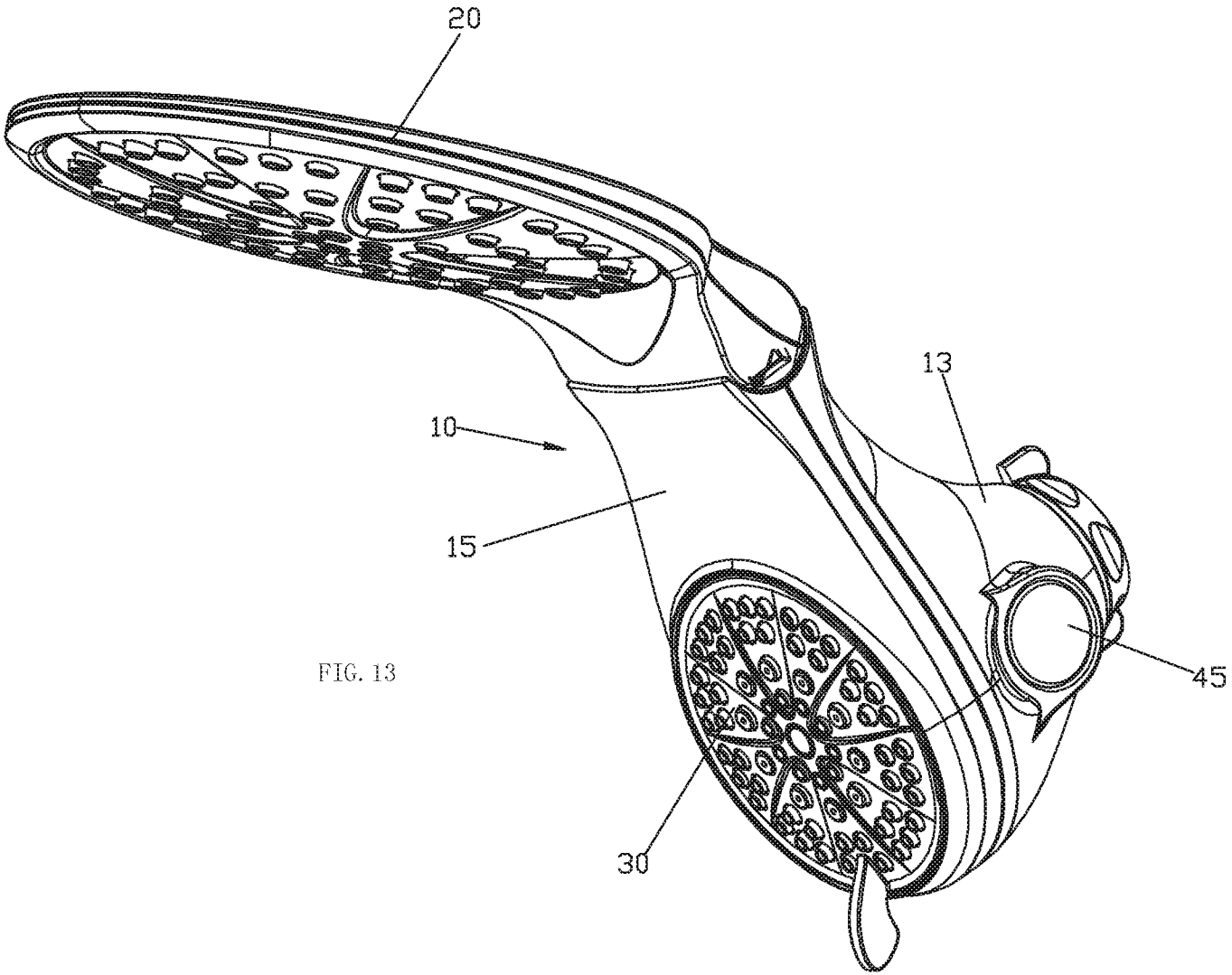
FIG. 13 illustrates a perspective schematic diagram of the combination showerhead of another preferred embodiment.
Figure 14:
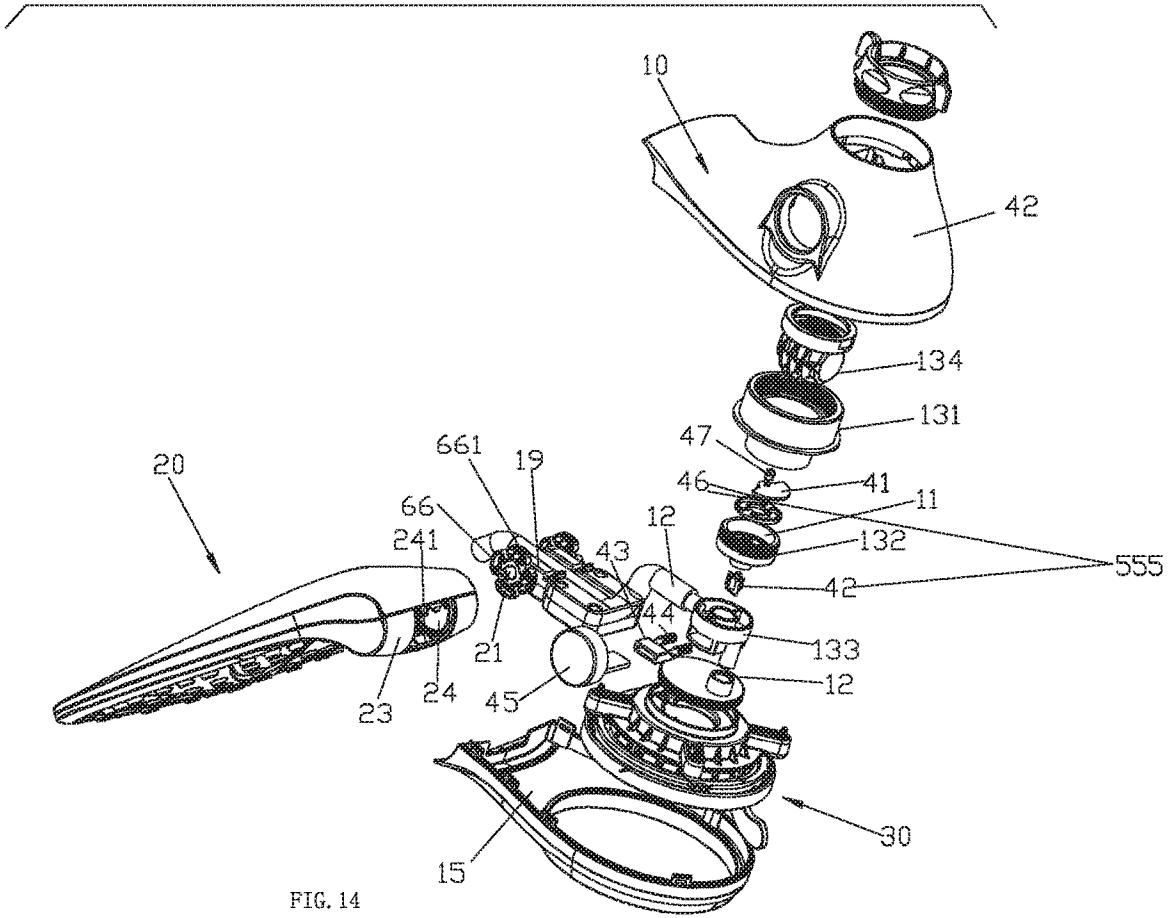
FIG. 14 illustrates an exploded perspective schematic diagram of the combination showerhead of another preferred embodiment.

In another preferred embodiment as shown in FIG. 13 to FIG. 14, the different comparing to above embodiment is that: the second showerhead 30 is fixed showerhead fixed on the front lower part of the common portion of fixing holder 10, and water passage of the diversion body connects to fixed showerhead directly. The common portion is convexly disposed with a convex part 19, and the first showerhead is convexly disposed with two convex lugs 23. Convex part 19 is configured between two convex lugs and the first showerhead is connected to convex part via pivot. The pivot is hollow for the other diversion passages passing through to connect to the first showerhead. The damping mechanism is configured between the convex part and the convex lugs, which comprises a connecting part 66 disposed on convex part 19. There could be one connecting part 66 having cylindrical surface, or more than one connecting parts 66 arrange in circumferential direction separately with each one has cylindrical surface. The cylindrical surface is convexly disposed with damping teeth 661. Convex lug 23 is concavely disposed with groove 24 which sleeve-connecting to the connecting part. Inner wall of groove 24 is also convexly disposed with damping teeth 221 separately mating damping teeth 661 to realize damping.

In another preferred embodiment, the diversion plate is just rotatably connected to the fixing holder 10 without ratchets. Since sliding of the diversion plate is limited, and with co-ordination of ratchets in the valve core and shaft, the valve core drives shaft together with diversion plate to rotate in predetermined angle directly.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A combination showerhead with press button switching of waterways, comprising:

a fixing holder that is mounted to a supporting arm and that comprises an inlet passage connected to the supporting arm and at least two diversion passages;

a first showerhead that is mounted to the fixing holder and that is connected to at least one diversion passage of the at least two diversion passages;

a second showerhead connected to another diversion passage of the at least two diversion passages;

a switching mechanism that comprises:

a diversion plate that is at least movable relative to the fixing holder and that cooperates with the inlet passage and the at least two diversion passages to switch waterways by a predetermined angle of rotation;

a sliding block that is slidably connected to the fixing holder;

a transmission mechanism that is connected between the sliding block and the diversion plate to drive the diversion plate to rotate in the predetermined angle of rotation by back-and-forth sliding of the sliding block; and a press button that is movably connected to the fixing holder and that is connected to the sliding block to drive the sliding block to slide, wherein the transmission mechanism comprises a valve core slidably connected to the fixing holder and a shaft fixed to the diversion plate, wherein the valve core and the sliding block each slide in sliding directions that intersect, and sliding of the sliding block drives the valve core to slide, and wherein back-and-forth sliding of the valve core drives the shaft along with the diversion plate to rotate in the predetermined angle of rotation.

2. The combination showerhead with press button switching according to claim 1, wherein an end of the valve core, an end of the shaft, and the fixing holder (10) are disposed with ratchets, wherein the diversion plate is rotatable and movable along a rotation axis relative to the fixing holder, wherein the switching mechanism further comprises an elastomer that abuts against and between the diversion plate and the fixing holder, and wherein the ratchets disposed on each of the end of the valve core, the shaft, and the fixing holder cooperate to form a lead.

3. The combination showerhead with press button switching according to claim 1, wherein the sliding block is disposed with a first inclined plane that is an inclined guide plane and the valve core abuts against the first inclined guide plane of the sliding block.

4. The combination showerhead with press button switching according to claim 3, wherein the valve core has a bottom that is disposed with a second inclined plane that is a second inclined guide plane and the second inclined guide plane abuts against the first inclined guide plane.

5. The combination showerhead with press button switching according to claim 1, wherein the press button is slidably connected to the fixing holder, and the press button abuts against or is fixed on the sliding block.

6. The combination showerhead with press button switching according to claim 1, wherein the switching mechanism further comprises a spring that abuts against and between the sliding block and the fixing holder.

7. The combination showerhead with press button switching according to claim 1, wherein the fixing holder has a back that is convexly disposed with an assembly portion, and wherein the switching mechanism is disposed inside the assembly portion, the press button is movably connected to the assembly portion with at least a portion of the press button being located outside of the fixing holder for pressing.

8. The combination showerhead with press button switching according to claim 7, wherein the second showerhead has a handle and is a handle showerhead, wherein the another diversion passage of the least two diversion passages has an outlet connected to the second showerhead that is disposed on a sidewall of the assembly portion, and the handle showerhead connects with a corresponding outlet through a flexible hose, and wherein the fixing holder (10) has a front lower portion that is disposed with a connecting portion for positioning the handle showerhead.

9. The combination showerhead with press button switching according to claim 7, wherein the fixing holder has a front lower portion and the second showerhead is a fixed showerhead that is fixed on the front lower portion of the fixing holder.

10. The combination showerhead with swing button switching according to claim 7, wherein the fixing holder has a common portion and two forking portions that extend from the common portion, and the first showerhead is rotatably connected between the two forking portions, and wherein the first showerhead has a rotation axis, and a hose piece is disposed along the rotation axis of the first showerhead and is connected to the first showerhead, and at least one diversion passage of the at least two diversion passages is connected to the first showerhead along the hose piece.

11. The combination showerhead with press button switching according to claim 10, wherein the assembly portion is disposed on a back of the common portion.

12. The combination showerhead with press button switching according to claim 3, wherein the first showerhead is rotatably connected to the fixing holder, and a damping mechanism is disposed between the fixing holder and the first showerhead.

13. The combination showerhead with press button switching according to claim 12, wherein the damping mechanism comprises:

a locating holder from which extend at least two dangling portions;

a turning block having a cylindrical inner wall that surrounds the at least two dangling portions and within which the at least two dangling portions are separately circumferentially disposed; and a cam disposed within the at least two dangling portions, wherein the at least two dangling portions each have an inner wall having a variable radius and cooperate to form a rotary sleeve structure within which the cam is disposed, and the turning block is sleeved on the rotary sleeve structure, and wherein the at least two dangling portions and the turning block have a frictional force therebetween that changes with rotation of the cam relative to the variable radius of respective inner walls of the at least two dangling portions to vary damping by the damping mechanism.

14. The combination showerhead with press button switching according to claim 7, wherein the fixing holder has a common portion and the first showerhead is rotatably connected to the common portion, and wherein the first showerhead has a rotation axis, and at least a hose piece is disposed along the rotation axis of the first showerhead and is connected to the first showerhead, and wherein at least one diversion passage of the at least two diversion passages is connected to the first showerhead along the hose piece.

* * * * *